US009377760B2

(12) United States Patent
Von Gruenigen et al.

(10) Patent No.: US 9,377,760 B2
(45) Date of Patent: Jun. 28, 2016

(54) PART FOR A TIMEPIECE MOVEMENT

(71) Applicant: Omega S.A., Bienne (CH)

(72) Inventors: Cedric Von Gruenigen, Neuchatel (CH); Christian Charbon, Chezard-St-Martin (CH); Marco Verardo, Les Bois (CH)

(73) Assignee: Omega S.A., Bienne 4 (CH)

( * ) Notice: Subject to any disclaimer, the term of this patent is extended or adjusted under 35 U.S.C. 154(b) by 0 days.

(21) Appl. No.: 14/153,150

(22) Filed: Jan. 13, 2014

(65) Prior Publication Data

US 2014/0198624 A1 Jul. 17, 2014

(30) Foreign Application Priority Data

Jan. 17, 2013 (EP) ..... 13151671

(51) Int. Cl.

| | |
|---|---|
| ***G04B 15/14*** | (2006.01) |
| ***G04B 1/16*** | (2006.01) |
| ***G04B 13/02*** | (2006.01) |
| ***G04B 17/32*** | (2006.01) |

(52) U.S. Cl.
CPC *G04B 15/14* (2013.01); *G04B 1/16* (2013.01); *G04B 13/026* (2013.01); *G04B 17/32* (2013.01)

(58) Field of Classification Search
CPC ..... G04B 1/16; G04B 13/026; G04B 15/14; G04B 17/32; Y10T 29/49581
USPC ..... 368/124, 127, 130, 169, 322–325; 29/896.31
See application file for complete search history.

(56) References Cited

U.S. PATENT DOCUMENTS

| | | | | | |
|---|---|---|---|---|---|
| 3,099,128 | A | * | 7/1963 | Straumann | 368/325 |
| 3,918,138 | A | * | 11/1975 | Nemeth et al. | 75/237 |
| 3,934,406 | A | * | 1/1976 | Bornand | 368/325 |
| 4,684,405 | A | * | 8/1987 | Kolaska et al. | 75/240 |
| 5,145,506 | A | * | 9/1992 | Goldstein et al. | 75/240 |
| 6,165,246 | A | * | 12/2000 | Kira | C22C 9/00 428/545 |

(Continued)

FOREIGN PATENT DOCUMENTS

| | | | |
|---|---|---|---|
| DE | 11 74 518 | B | 7/1964 |
| FR | 2 183 549 | A1 | 12/1973 |
| WO | WO 2010/088891 | A2 | 8/2010 |

OTHER PUBLICATIONS

European Search Report issued Aug. 6, 2013, in Patent Application No. EP 13 15 1671, filed Jan. 17, 2013 (With English Translation).

*Primary Examiner* — Amy Cohen Johnson
*Assistant Examiner* — Matthew Powell
(74) *Attorney, Agent, or Firm* — Oblon, McClelland, Maier & Neustadt, L.L.P

(57) ABSTRACT

The invention relates to a pivot pin for a timepiece movement including at least one pivot at at least one of the ends thereof, characterized in that said at least one pivot is formed of a composite material having a metallic matrix including at least one metal selected from among nickel, titanium, chromium, zirconium, silver, gold, platinum, silicon, molybdenum, aluminum or an alloy of the above metals, said matrix being charged with hard particles selected from among WC, TiC, TaC, TiN, TiCN, Al2O3, ZrO2, Cr2O3, SiC, MoSi2, Al N or a combination thereof, so as to limit the sensitivity of the pin to magnetic fields.

The invention concerns the field of timepiece movements.

13 Claims, 1 Drawing Sheet

(56) References Cited

U.S. PATENT DOCUMENTS 6,521,353 B1 * 2/2003 Majagi ..... B22F 3/156 428/565
6,723,387 B1 * 4/2004 Kear ..... C23C 4/06 106/286.8
6,911,063 B2 * 6/2005 Liu ..... B22F 3/16 75/236
2003/0099853 A1 * 5/2003 Takayama ..... C22C 9/02 428/553
2004/0094537 A1 * 5/2004 Tanaka ..... C22C 1/1036 219/548
2006/0002241 A1 * 1/2006 Verardo et al. ..... 368/175
2007/0098987 A1 * 5/2007 Huddleston ..... C22C 19/05 428/402
2007/0102199 A1 * 5/2007 Smith ..... B22F 7/062 175/374
2007/0119276 A1 * 5/2007 Liu ..... B23K 20/1255 75/232
2007/0140065 A1 * 6/2007 Levingston ..... 368/127
2009/0041609 A1 * 2/2009 Duz ..... C22C 32/0047 419/12
2010/0002548 A1 * 1/2010 Hessler et al. ..... 368/129
2011/0038234 A1 * 2/2011 Mignot et al. ..... 368/293
2011/0146448 A1 * 6/2011 Fujitsuka ..... C22C 1/1084 75/237
2011/0292770 A1 * 12/2011 Damasko ..... 368/175
2013/0286795 A1 * 10/2013 Conus et al. ..... 368/127

* cited by examiner

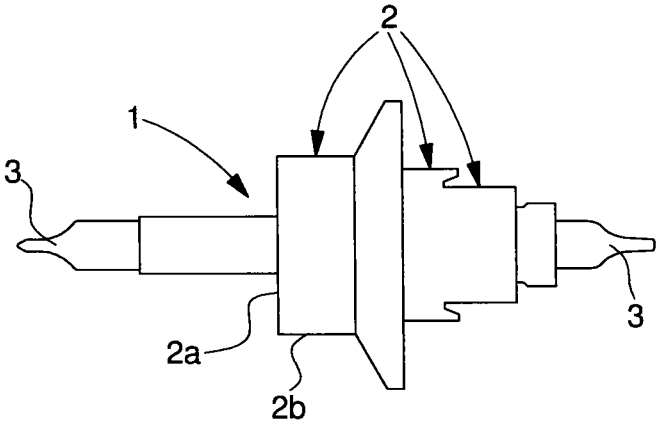
Fig. 1
Fig. 2
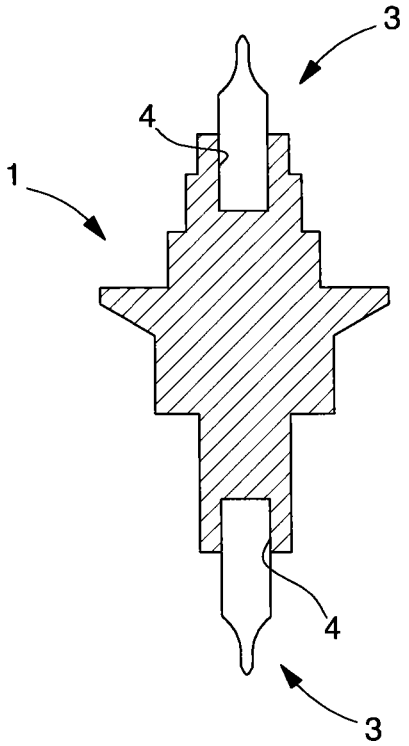
Fig. 3
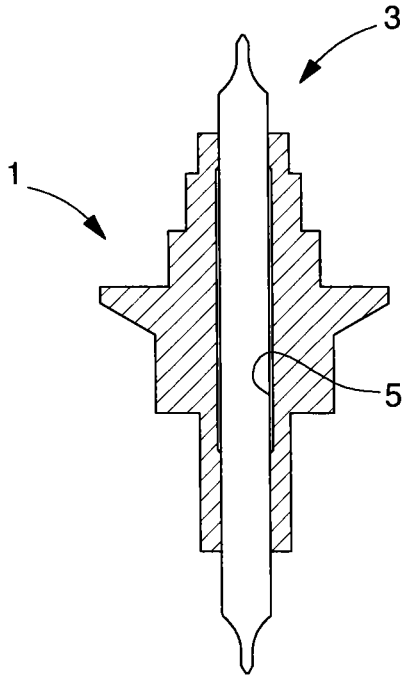

PART FOR A TIMEPIECE MOVEMENT

This application claims priority from European Patent application No. 13151671.8 filed Jan. 17, 2013, the entire disclosure of which is hereby incorporated by reference.

FIELD OF THE INVENTION

The invention relates to a part for a timepiece movement and particularly to a non-magnetic pivot pin for a mechanical timepiece movement and more particularly to a non-magnetic escape pinion, balance staff and pallet staff.

BACKGROUND OF THE INVENTION

The manufacture of a pivot pin for a timepiece consists in performing bar turning operations on a hardenable steel bar to define various active surfaces (shoulder, projecting portion, pivots, etc.) and then in subjecting the bar-turned pin to heat treatments including at least one hardening operation to improve the hardness of the pin and one or more tempering operations to improve the roughness. The heat treatment operations are followed by an operation of rolling the pin pivots, which consists in polishing the pivots to the required dimensions. The rolling operation also improves the hardness and the roughness of the pivots. It will be noted that this rolling operation is very difficult or even impossible to achieve with materials having a low hardness, i.e. less than 600 HV.

The pivot pins, for example the balance staffs, conventionally used in mechanical timepiece movements are made in bar turning steel grades which are generally martensitic carbon steels including lead and manganese sulphides to improve their machinability. A known steel of this type, designated 20AP, is typically used for these applications.

This type of material has the advantage of being easy to machine, in particular of being suitable for bar turning and, after hardening and tempering, has superior mechanical properties which are very advantageous for making timepiece pivot pins. These steels have, in particular, superior wear resistance and hardness after heat treatment. Typically, the hardness of pin pivots made of 20AP steel can exceed 700 HV after heat treatment and rolling.

Although this type of material provides satisfactory mechanical properties for the timepiece applications described above, it has the drawback of being magnetic and able to disrupt the working of a watch after being subjected to a magnetic field, particularly when the material is used to make a balance staff cooperating with a balance spring made of ferromagnetic material. This phenomenon is well known to those skilled in the art and is for example described in the *Bulletin Annuel Suisse de Chromométrie Vol. I*, pages 52 to 74. It should also be noted that these martensitic steels are also corrosion sensitive.

Attempts have been made to try to overcome these drawbacks with austenitic stainless steels which have the peculiarity of being non-magnetic, namely paramagnetic or diamagnetic or antiferromagnetic. However, these austenitic steels have a crystallographic structure which means that they cannot be hardened or achieve hardnesses and thus wear resistances compatible with the requirements necessary for making timepiece pivot pins. One means of increasing the hardness of these steels is cold working; however this hardening operation cannot achieve hardnesses of more than 500 HV. Consequently, for parts which require high resistance to wear due to friction and pivots which have little or no risk of breakage or deformation, the use of this type of steel remains limited.

Another approach for attempting to overcome these drawbacks consists in depositing on the pivot pins hard layers of materials such as diamond-like-carbon (DLC). However, there have been observed significant risks of delamination of the hard layer and thus the formation of debris which can move around inside the watch movement and disrupt the operation of the timepiece, which is unsatisfactory.

Yet another approach has been envisaged for overcoming the drawbacks of austenitic stainless steels, namely the superficial hardening of the pivot pins by nitriding, carburizing or nitrocarburizing. However, these treatments are known to cause a significant loss of corrosion resistance because of the reaction of the nitrogen and/or carbon with the chromium in the steel and the formation of chromium nitride and/or chromium carbide causing localised depletion of the chromium matrix, which is detrimental to the desired timepiece application.

SUMMARY OF THE INVENTION

It is an object of the invention to overcome all or part of the aforementioned drawbacks by proposing a pivot pin which both limits sensitivity to magnetic fields and can achieve an improved hardness compatible with the demands for wear resistance and shock resistance required in the horological industry.

It is also an object of the invention to provide a non-magnetic pivot pin having improved corrosion resistance.

It is yet another object of the invention to provide a non-magnetic pivot pin which can be manufactured simply and economically.

The invention therefore relates to a pivot pin for a timepiece movement including at least one pivot at at least one of the ends thereof, characterized in that said at least one pivot is formed of a composite material having a metallic matrix including at least one metal selected from among nickel, titanium, chromium, zirconium, silver, gold, platinum, silicon, molybdenum, aluminium or an alloy of the above metals, said matrix being charged with hard particles selected from among WC, TiC, TaC, TiN, TiCN, Al2O3, ZrO2, Cr2O3, SiC, MoSi2, Al N or a combination thereof, so as to limit the sensitivity of the pin to magnetic fields.

Consequently, the entire pin or at least the pivots have a high hardness, the pivot pin thus being able to combine advantages such as low sensitivity to magnetic fields, and in the main areas of stress, high resistance to corrosion and wear, while maintaining good general roughness.

According to a preferred embodiment, the entire pin is formed of said composite material and the composite material includes at least 75% hard particles, and the hardness of the composite material is higher than or equal to 1000 HV and preferably higher than 1200 HV.

Preferably, the size of the hard particle grains is comprised between 0.1 microns and 5 microns.

Advantageously, the roughness of the composite material is higher than 8 $MPa \cdot m^{1/2}$.

According to a variant of the invention the pivot or pivots are made of composite material and are placed in housings arranged at the ends of the pin, the pin being made of a paramagnetic, diamagnetic or antiferromagnetic material.

According to another variant, the two pivots are made in a single piece of composite material and said piece of composite material forming the pivots is placed in a through hole extending along the longitudinal axis of the pin to project on either side of the pin, the pin being made of paramagnetic, diamagnetic or antiferromagnetic material.

Moreover, the invention relates to a timepiece movement, characterized in that the movement includes a pivot pin according to any of the preceding variants, and in particular a balance staff, a pallet staff and/or an escape pinion including a pin according to any of the these variants.

BRIEF DESCRIPTION OF THE DRAWINGS

Other features and advantages will appear clearly from the following description, given by way of non-limiting illustration, with reference to the annexed drawings, in which:

FIG. 1 is a diagram of a pivot pin according to the invention.

FIG. 2 is a cross-section of first variant of a balance staff according to the invention.

FIG. 3 is a cross-section of a second variant of a balance staff according to the invention.

DETAILED DESCRIPTION OF PREFERRED EMBODIMENTS

The invention relates to a part for a timepiece movement and particularly to a non-magnetic pivot pin for a mechanical timepiece movement.

The invention will be described below with reference to an application to a non-magnetic balance staff 1. Of course, other types of timepiece pivot pins may be envisaged such as, for example, timepiece wheel set arbours, typically escape pinions or pallet staffs.

Referring to FIG. 1, there is shown a balance staff 1 according to the invention, which includes a plurality of sections 2 of different diameters conventionally defining shoulders 2*a* and projecting portions 2*b* arranged between two end portions defining pivots 3. These pivots are intended each to pivot in a bearing typically in an orifice in a jewel or ruby.

With the magnetism induced by objects that are encountered on a daily basis, it is important to limit the sensitivity of balance staff 1 to avoid affecting the working of the timepiece in which it is incorporated.

Surprisingly, the invention overcomes both problems at the same time with no comprise and provides additional advantages. The material of which staff 1 is formed is therefore a composite material having a metallic matrix including at least one metal selected from among nickel, titanium, chromium, zirconium, silver, gold, platinum, silicon, molybdenum, aluminium or an alloy of the above metals, said matrix being charged with hard particles selected from among WC, TiC, TaC, TiN, TiCN, Al2O3, ZrO2, Cr2O3, SiC, MoSi2, Al N or a combination thereof. The non-magnetism, i.e. the paramagnetic, diamagnetic or antiferromagnetic nature of these composite materials advantageously reduces the sensitivity of the staff to magnetic fields.

Further, according to the invention, the roughness of balance staff 1 is on the order of 8 $MPa \cdot m^{1/2}$ for a hardness of more than 1300 HV. The above values were obtained with a composite material comprising 92% WC and 8% nickel. A pivot pin is therefore obtained with high resistance to wear.

An example method of producing a pivot pin, such as balance staff 1, from composite material will be described below. First of all, a powder is taken formed of particles of one or more hard materials, for example a carbon tungsten powder. The powder used has a mean granulometric size on the order of a micrometer, typically from 0.1 to 5 micrometers.

The hard material powder is then mixed with a matrix intended to form the binder between the hard particles, for example a nickel alloy (typically an Ni and titanium alloy which, during processing, will allow the titanium to be combined with the carbon to form carbides and release the tungsten which will form a NiW matrix as disclosed in U.S. Pat. No. 3,918,138 which is incorporated herein by reference). The mixture obtained is homogenised, for example in a conventional atomizer. The granule obtained is sieved, typically to 300 micrometers. The sieved granule is then injected into a mould having the configuration of the desired balance staff to form a blank of said staff. The mould is of course dimensioned to take account of any shrinkage that the staff may experience during the subsequent sintering step. It will be noted in this regard that the dimensions are larger than the final dimensions of the staff. After injection, the staff is removed from the mould. The staff is then placed in a sintering furnace in which it is heated to between 1300° C. and 1600° C. for approximately one hour. The staff is removed from the furnace and cooled. The staff and notably the pivots are then polished, for example using a diamond paste, to achieve the desired dimensional features.

Evidently, other composite materials may be envisaged provided that the proportion of hard particles therein confers both a hardness higher than or equal to 1000 HV and paramagnetic or diamagnetic properties.

Alternatively, it is possible to machine the staff according to the invention from a round bar made of the composite materials defined above.

Since the hardness of pivots 3 is obtained directly from the material of the actual pivots 3, advantageously according to the invention, this prevents any subsequent delamination during use.

Of course, this invention is not limited to the illustrated example but is capable of various variants and alterations that will appear to those skilled in the art.

In particular, it may be envisaged to make only pivots 3 from a composite material and to place the pivots in housings 4 arranged at the ends of the staff as illustrated in FIG. 2.

According to another variant, pivots 3 of the staff are made in a single piece placed in a through hole 5 extending along the longitudinal axis of staff 1 to project either side of the balance staff as illustrated in FIG. 3.

In the latter two variants, the staff is advantageously made of a paramagnetic, diamagnetic or antiferromagnetic material, such as brass, nickel silver, CuBe or austenitic steel and the pivots are preferably retained by being driven into housings 4 or through hole 5 respectively.

What is claimed is:

1. A pivot pin for a timepiece movement, comprising:

at least one pivot at at least one end of the pivot pin, wherein said at least one pivot is formed of a composite material having a nonferrous metallic matrix including at least one metal selected from among zirconium, silver, gold, platinum, silicon, molybdenum, aluminium, or an alloy of the above metals, said matrix being charged with hard particles selected from among TaC, TiN, TiCN, Al2O3 ZrO2, Cr2O3, SiC, MoSi2, AlN, or a combination thereof, so as to limit the sensitivity of the pin to magnetic fields.

2. The pivot pin according to claim 1, wherein said composite material includes at least 75% hard particles.

3. The pivot pin according to claim 1, wherein the hardness of said composite material is greater than or equal to 1000 HV.

4. The pivot pin according to claim 1, wherein a size of grains of the hard particles is comprised between 0.1 microns and 5 microns.

5. The pivot pin according to claim 1, wherein a roughness of the composite material is greater than 8 $MPa \cdot m^{1/2}$.

6. The pivot pin according to claim 1, wherein an entirety of the pivot pin is formed of said composite material.

7. The pivot pin according to claim 1, wherein the pin includes two pivots formed of said composite material.

8. The pivot pin according to claim 7, wherein the pivots are disposed in housings arranged at ends of the pin, and the pin is made of paramagnetic, diamagnetic, or antiferromagnetic material.

9. The pivot pin according to claim 7, wherein the pivots are made in a single piece, said single piece is disposed in a through hole extending along a longitudinal axis of the pin to project on either side of the pin, and the pin is made of paramagnetic, diamagnetic, or antiferromagnetic material.

10. A movement for a timepiece, wherein the movement includes a pivot pin according to claim 1.

11. A movement for a timepiece, wherein the movement includes a balance staff, a pallet staff and/or an escape pinion including a pin according to claim 1.

12. The pivot pin according to claim 1, wherein the hardness of said composite material is greater than or equal to 1200 HV.

13. A pivot pin for a timepiece movement, comprising:

at least one pivot at at least one end of the pivot pin, wherein said at least one pivot is formed of a composite material having a nonferrous metallic matrix including 8% nickel, said matrix being charged with hard particles comprising 92% WC, so as to obtain a high resistance to wear, and wherein the hardness of the composite material is more than 1300 HV.

* * * * *